US006907888B2

(12) United States Patent
Saida et al.

(10) Patent No.: US 6,907,888 B2
(45) Date of Patent: Jun. 21, 2005

(54) ION GENERATOR AND HAIRBRUSH USING THE SAME

(75) Inventors: Itaru Saida, Hikone (JP); Hisashi Kitamura, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 187 days.

(21) Appl. No.: 09/989,143

(22) Filed: Nov. 21, 2001

(65) Prior Publication Data

US 2002/0062836 A1 May 30, 2002

(30) Foreign Application Priority Data

Nov. 27, 2000 (JP) ..... 2000-358631
Nov. 27, 2000 (JP) ..... 2000-358632
Aug. 31, 2001 (JP) ..... 2001-264786

(51) Int. Cl.[7] ..... A45D 20/12

(52) U.S. Cl. ..... 132/271; 132/129; 132/116; 34/97

(58) Field of Search ..... 132/271, 129, 132/116, 112, 148, 152, 154, 272; 34/97; 607/29; 15/104.002, 246.3, 344, 345, 39.5, 40; 219/222

(56) References Cited

U.S. PATENT DOCUMENTS 3,862,420 A * 1/1975 Banks et al. ..... 250/324
4,559,467 A 12/1985 Beckmann et al.
4,632,135 A 12/1986 Lenting et al.
5,150,491 A * 9/1992 Ikemoto ..... 15/1.52
5,975,090 A * 11/1999 Taylor et al. ..... 132/116
6,168,689 B1 * 1/2001 Park et al. ..... 204/164
6,182,671 B1 * 2/2001 Taylor et al. ..... 132/116
6,588,434 B2 * 7/2003 Taylor et al. ..... 132/116

FOREIGN PATENT DOCUMENTS

JP 57115658 7/1982
JP 6-154027 6/1994
JP 6154027 * 6/1994 ..... 132/271
JP 6-182255 7/1994
JP 11191478 * 7/1999 ..... 132/271
WO 02/11526 2/2002

* cited by examiner

*Primary Examiner*—Pedro Philogene
(74) *Attorney, Agent, or Firm*—Greenblum & Bernstein, P.L.C.

(57) ABSTRACT

An ion generator includes a needle electrode and a ground electrode cooperable with the needle electrode to generate a corona discharge in the air to produce ions. The ground electrode is disposed so as to surround an imaginary extension of a longitudinal axis of the needle electrode and has a portion thereof depleted to provide a split region defined therein. A hairbrush utilizing the ion generator is also disclosed.

9 Claims, 13 Drawing Sheets

Fig.7A
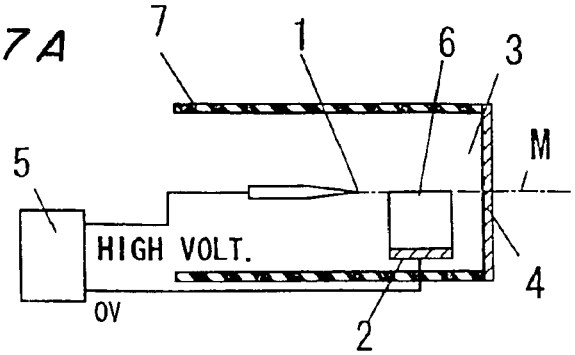
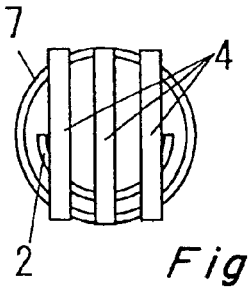
Fig.7B
Fig.8A
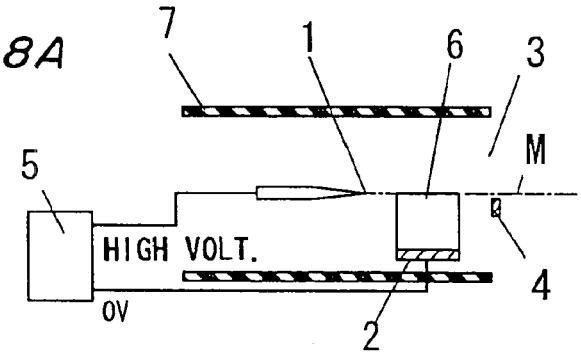
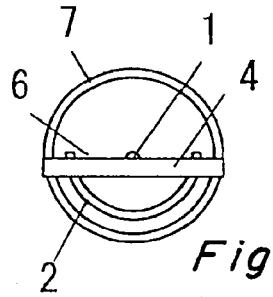
Fig.8B
Fig.9A
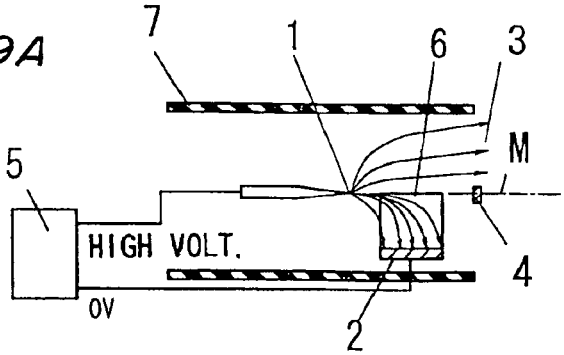
Fig.9B
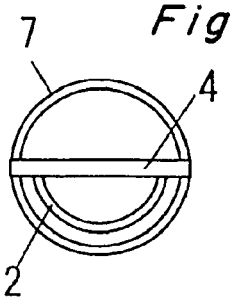
Fig.9C
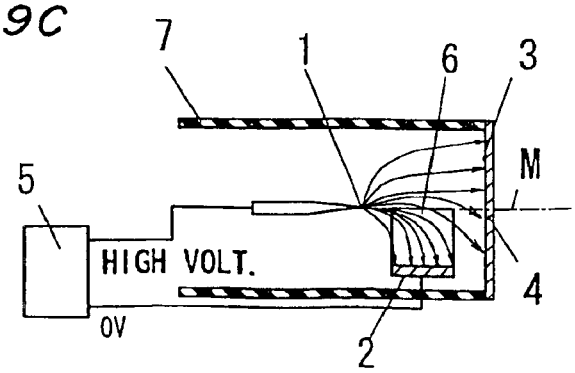
Fig.9D
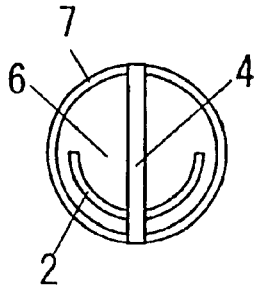

ION GENERATOR AND HAIRBRUSH USING THE SAME

BACKGROUND OF THE INVENTION

1. Field of the Invention

The present invention generally relates to an ion generator and a hairbrush utilizing such ion generator.

2. Description of the Prior Art

The conventional ion generator A generally includes a needle electrode 101 and a ring-shaped ground electrode 102, both of which are accommodated within a tubular body 107, for example, a cylindrical body made of an electrically insulating material. As shown in FIGS. 12A to 12C, the ground electrode 102 within the tubular body 107 is so positioned as to occupy a position coaxial with an imaginary extension M of the longitudinal axis of the needle electrode 101 for generating ions by effecting a corona discharge in the air. In an alternative arrangement not shown, the ground electrode 102 similar in shape to a flat rectangular plate is disposed forwardly and diagonally upwardly of the needle electrode. In either case, there has been a problem in that most of the ions generated by the corona discharge propagate towards the ground electrode 102 along a direction in which lines of electric force develops from the needle electrode 101 to the ground electrode 102 and, therefore, unless a propulsive force such as, for example, wind is applied externally to the ions, the ions are unable to emerge outwardly from a blowoff port 103 at one end of the tubular body 107 remote from the needle electrode 101.

FIGS. 13A and 13B illustrates the lines of electric force developed where the ground electrode 102 of a ring shape is disposed coaxial with the imaginary extension M of the longitudinal axis of the needle electrode 101 for generating ions by effecting a corona discharge in the air. As shown therein, the lines of electric force extend from the needle electrode 101 towards the ring-shaped ground electrode 102 and, accordingly, the ions do not emerge outwardly from the blowoff port 103, but travel in most quantity towards the ground electrode 102. Thus, unless a propulsive force such as, for example, wind is applied externally to the ions, the ions are unable to emerge outwardly from a blowoff port 103 at one end of the tubular body 107 remote from the needle electrode 101.

Another conventional ion generator shown in FIG. 30 includes a needle electrode 101 and a ground electrode 102, both accommodated within a tubular casing 109, and a high voltage generator 5 disposed within a housing 110 together with the casing 109. The housing 110 is a molded product or is made of metal. In this arrangement, there has been a similar problem in that most of the ions generated by the corona discharge taking place between the needle electrode 101 and the ground electrode 102 tend to deposit and be electrostatically charged on a portion of the housing 110, in the form of the molded product or made of metal, around the blowoff port 103 and do not therefore emerge outwardly from the blowoff port 103 as shown in FIG. 31. Even the ion generator shown in FIG. 30, unless a propulsive force such as, for example, wind is applied externally to the ions, the ions are unable to emerge outwardly from the blowoff port 103 at one end of the tubular casing 109 remote from the needle electrode 101.

The Japanese Laid-open Patent Publication No. 11-191478, for example, discloses the ion generator that does not make use of any ground electrode. According to this publication, the ion blowoff port is electrically connected with an alternating current source through a resistor to thereby avoid a charge build up at the blowoff port. However, in this prior art ion generator in which no ground electrode is employed and, instead, the ion blowoff port is connected with the alternating current source through the resistor, the absence of the ground electrode does not make it possible to form an electric field that is necessary to generate ions outside and, therefore, no ion can be generated stably.

As an alternative embodiment, the above referenced patent publication also discloses the ion blowoff port connected direct with the ground only where the blowoff port has a grille or a grid made of a semiconductor material.

The use of the ion generator in a hairbrush is contemplated so that the user of the hairbrush can take care of his or her hair while ions generated from the ion generator are applied to the hair. The inventors of the present invention have suggested the hairbrush of a structure shown in FIGS. 32 to 34, reference to which will now be made.

As best shown in FIGS. 32 and 33, the hairbrush B includes a tubular handle and a brush head at one end of the handle. The brush head has a generally oval brush base 112 on which a multiplicity of bristles 113 are fixedly planted, or otherwise formed integrally therewith by means of an injection molding technique. The brush base 112 also has a center hole 112*a* aligned with the ion blowoff port 103 of the ion generator A, encased within the brush head, so that ions generated from the ion generator A can emerge outwardly of the brush head through the center hole 112*a* by way of the ion blowoff port 103 to deposit on the user's hair during the hair brushing.

It has, however, been found that the hairbrush of the structure shown in FIGS. 32 to 34 and having the ion generator built therein has a problem in that because of the presence of the bristles 13 in the vicinity of the ion blowoff port 103 and around the center hole 112*a* as shown therein, some of the ions so generated from the ion generator A tend to deposit on some of the bristles 113, causing the bristles 113 to be electrostatically charged to such an extent as to adversely affect the electric field therearound with the consequence that the ions do not emerge outwardly of the brush head sufficiently.

More specifically, when minus ions, that is, anions are generated from the ion generator A, the anions so generated tend to deposit on some of the bristles 113 adjacent the center hole 112*a*, causing the bristles 113 to be charged to a negative polarity. Once the bristles 113 adjacent the center hole 112*a* are charged to the negative polarity, it has been found that the negative charge acts to repel the anions and, therefore, the ions cannot emerge outwardly of the brush head.

Conversely, if plus ions, that is, cations are generated from the ion generator A, the cations so generated tend to deposit on some of the bristles 113 adjacent the center hole 112*a*, causing the bristles 113 to be charged to a positive polarity. Once the bristles 113 adjacent the center hole 112*a* are charged to the positive polarity, it has also been found that the positive charge acts to repel the cations and, therefore, the ions cannot emerge outwardly of the brush head.

Because of the reasons discussed above, even though the ion generator A is built in the hairbrush B, the ions generated from the ion generator A can not be continually blown off to the outside of the brush head so as to travel towards a site desired to be treated with ions.

SUMMARY OF THE INVENTION

Accordingly, the present invention has been developed to substantially eliminate the above discussed problems found with the conventional ion generators and the hairbrush utilizing the same and is intended to provide an improved ion generator of a simplified structure which is effective to blow off the ions to the outside with no need to apply any external propulsive force such as wind to the ions.

It is another object of the present invention to provide an improved hairbrush wherein means is provided to avoid deposition of the ions on some of the bristles to thereby allow the ions generated by the ion generator to be blow off continually towards the hair being brushed.

In order to accomplish these and other objects, the present invention provides an ion generator including a needle electrode and a ground electrode cooperable with the needle electrode to generate a corona discharge in the air to produce ions. The ground electrode is disposed so as to surround an imaginary extension of a longitudinal axis of the needle electrode and has a portion thereof depleted to provide a split region defined therein.

According to the present invention, the presence of the split region defined in the ground electrode is effective in that some of the lines of electric force emanating from the needle electrode can extend outwardly of the ground electrode through the split region and the rest of the lines of electric force extend outwardly and, therefore, the ions can be blow off to the outside of the ion generator.

The ground electrode having the split region defined therein may take a generally U-sectioned shape, a semicircular-sectioned shape, a polygonal sectional shape or a square sectioned shape.

Preferably, an ion blowoff port from which the ions produced by the corona discharge emerge outwardly of the ion generator is provided, and a guard member provided on the ion blowoff port for avoiding ingress of foreign matter inwardly of the ion blowoff port. Where the ion generator is used in a hairbrush, the presence of the guard member is effective to avoid ingress of hairs being combed into the ion generator. This guard member may represents a grid shape or may be made up of two transverse bars positioned forwardly of the ground electrode so as to traverse the ground electrode at two locations, respectively.

In a preferred embodiment of the present invention, a distance from a sharpened end of the needle electrode to a center of the ground electrode surrounding the imaginary extension of the longitudinal axis of the needle electrode is chosen to be substantially equal to a radius of curvature of the ground electrode, for enhancing emergence of the ions to the outside of the ion generator through the split region.

Alternatively, an ion generator may include a needle electrode, a ground electrode cooperable with the needle electrode to generate a corona discharge in the air to produce ions, an outer body disposed at or in a vicinity of an ion blowoff port, and a resistance element through which the ground electrode is connected with the outer body. Connection of the ground electrode with the outer body through the resistance element is effective to minimize electrification of a portion adjacent the ion blowoff port, allowing the ions to be emitted to the outside without being disturbed.

The resistance element may be made of a material having a high resistance or a semiconductor. The outer body may be a brush head of a hairbrush.

Where the ground electrode is connected with the outer body by way of an electroconductive plate fitted to the outer body, through the resistance element, distribution of electrification of the outer body can be effectively minimized.

The present invention also provides an ion generator including a needle electrode, a ground electrode cooperable with the needle electrode to generate a corona discharge in the air to produce ions, an outer body disposed on an ion emission side and exposed to an outside, said outer body being made of an antistatic material and connected with the ground electrode.

The present invention furthermore provides a hairbrush utilizing the ion generator of a kind discussed above. Specifically, this hairbrush includes an ion generator for emitting ions; and a brush head having a brush base formed with a multiplicity of bristles. The brush base has an opening defined therein for passage of the ions from the ion generator to an outside of the hairbrush, and some of the bristles around the opening in the brush base are removed to provide a plain surface area where no bristle exist.

Where it is desired that the ions emerging outwardly from the hairbrush should not interfere with the bristles, which would otherwise result in electrification of the bristles, a surface area encompassed by a cone having its apex occupied by the discharge electrode and flaring outwardly away from the discharge electrode and passing in touch with a peripheral lip region defining the opening in the brush base may have no bristle formed therein. Equally, a portion of the brush base around the opening may be made of a material having a low electroconductivity, an electrically insulating material or an antistatic material.

To provide a visible indication that the ions are being generated, the hairbrush may have an indicator disposed on the brush base adjacent the opening. Also, an ion guide tube made of an electrically insulating material may be disposed so as to intervene between the ion generator and the brush base for guiding the ions towards an outside of the hairbrush.

BRIEF DESCRIPTION OF THE DRAWINGS

The present invention will become readily understood from the following description of preferred embodiments thereof made with reference to the accompanying drawings, in which like parts are designated by like reference numeral and in which:

FIGS. 7A and 7B are views similar to FIGS. 1A and 1B, respectively, showing a sixth preferred embodiment of the present invention;

FIGS. 8A and 8B are views similar to FIGS. 1A and 1B, respectively, showing a seventh preferred embodiment of the present invention;

FIGS. 9A and 9B are views similar to FIGS. 1A and 1B, respectively, showing an eighth preferred embodiment of the present invention;

FIGS. 9C and 9D are views similar to FIGS. 1A and 1B, respectively, showing the principle of operation of the ion generator show in FIGS. 9A and 9B;

DETAILED DESCRIPTION OF THE EMBODIMENTS

Figure 1A:
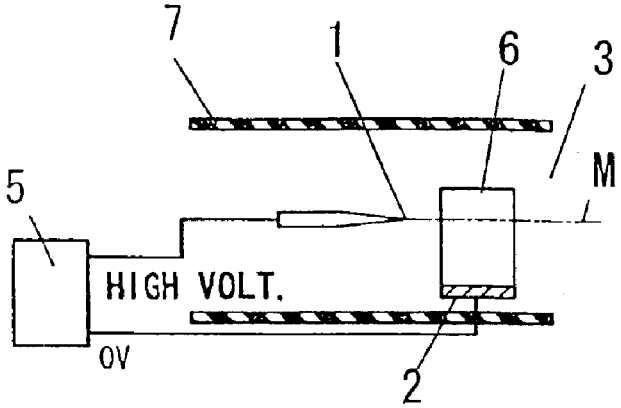
FIG. 1A is a schematic longitudinal sectional view of an ion generator according to one preferred embodiment of the present invention.
Figure 1B:
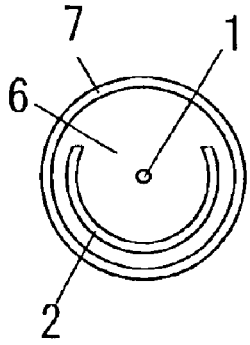
FIG. 1B is a front end view of the ion generator shown in FIG. 1.

An ion generator according to a first preferred embodiment of the present invention is shown in FIGS. 1A to 2B. As best shown in FIGS. 1A and 1B, the ion generator generally identified by A includes a needle electrode 1, a ground electrode 2 and a high voltage generator 5. The needle electrode 1 and the ground electrode 2 are accommodated within a casing 7 of, for example, a hollow cylindrical shape made of an electrically insulating material. The cylindrical casing 7 has an ion blowoff port 3 defined at one end thereof, and the needle electrode 1 and the ground electrode 6 are disposed inside the casing 7 with the ground electrode 2 positioned forwardly of the needle electrode 1 and adjacent the ion blowoff port 3.

The needle electrode 1 is of a shape generally similar to a sewing needle, having one end thereof sharpened. The ground electrode 2 positioned forwardly of the needle electrode 1 is made of a metallic plate curled to represent a generally U-shaped configuration to follow the curvature of an inner peripheral wall of the casing 7. In this configuration, the ground electrode 2 has a split region 6 communicating the interior of the ground electrode 2 to the outside. Within the casing 7, the ground electrode 2 is positioned so as to surround an imaginary extension M of the longitudinal axis of the needle electrode 1 and with the split region 6 opening upwardly as clearly shown in FIG. 1B.

The high voltage generator 5 is, where minus ions are desired to be generated, used to apply a direct current voltage of −5 kV to the needle electrode 1 relative to a reference potential assumed by the ground electrode 2. Conversely, the reverse is true where plus ions are desired to be generated, that is, the direct current voltage of +5 kV is applied to the ground electrode 2 relative to the reference potential assumed by the needle electrode 1.

Figure 2A:
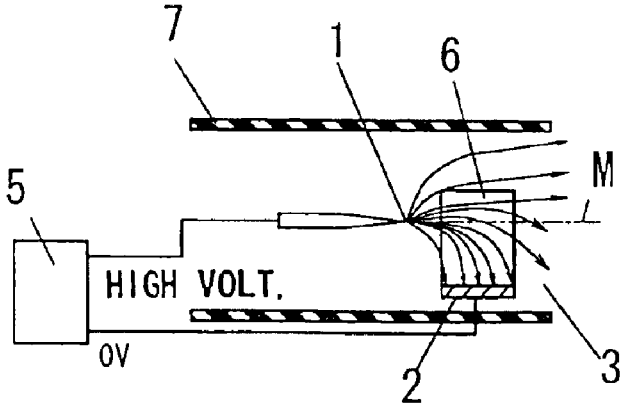
FIGS. 2A and 2B are views similar to FIGS. 1A and 1B, respectively, showing the principle of operation of the ion generator.
Figure 2B:
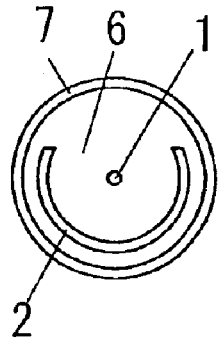

Assuming that the direct current voltage of −5 kV is applied from the high voltage generator 5 to the needle electrode 1 with the ground electrode 2 used as a reference, an electric field is developed and concentrates on the sharpened end of the needle electrode 1, resulting in a corona discharge occurring at the sharpened end of the needle electrode 1 to thereby produce minus ions as shown in FIG. 2A. Since the minus ions are charged to a minus charge, the minus ions travel towards along lines of electric force and, therefore, most of the minus ions travel towards the ground electrode 2.

Figure 12A:
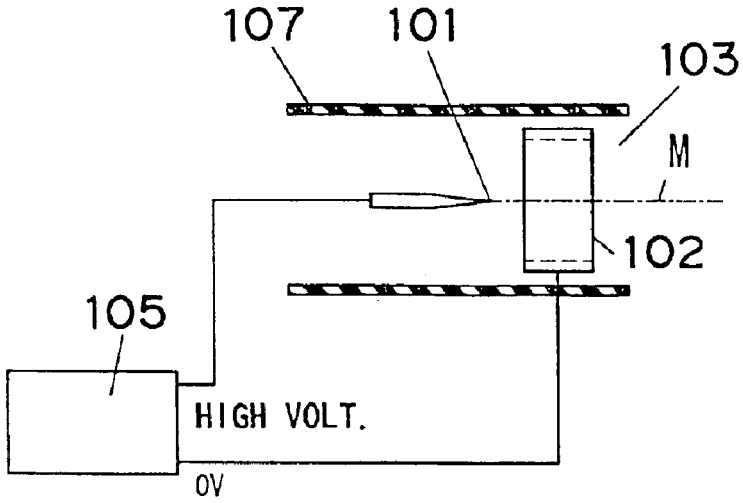
FIG. 12A is a schematic longitudinal sectional view of the conventional ion generator.
Figure 12B:
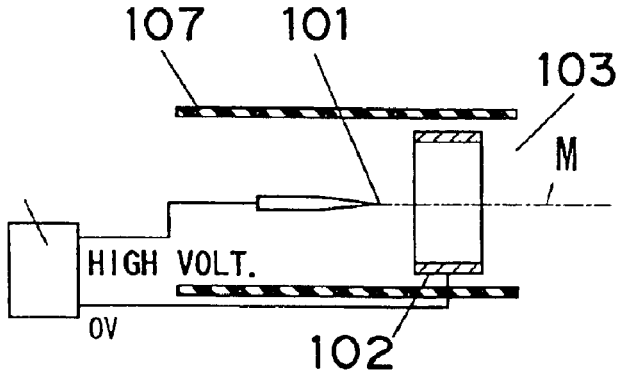
FIG. 12B is a schematic longitudinal sectional view of the conventional ion generator shown in FIG. 12A with the ground electrode shown also in a section.
Figure 12C:
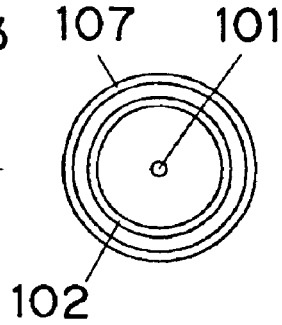
FIG. 12C is a front end view of the conventional ion generator of FIGS. 12A and 12B.
Figure 13A:
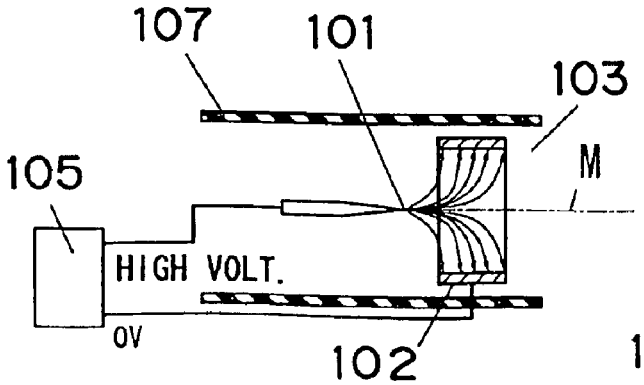
FIGS. 13A and 13B are views similar to FIGS. 12B and 12C, respectively, showing the principle of operation of the conventional ion generator of FIG. 12A.
Figure 13B:
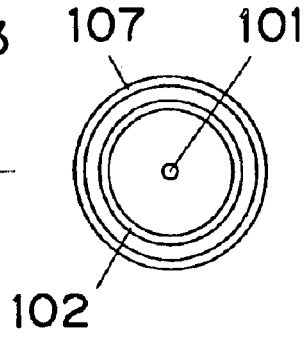

If the ground electrode of a ring shape such as the ground electrode 102 used in the conventional ion generator shown in FIGS. 12A to 12C is used so as to surround the imaginary extension M of the longitudinal axis of the needle electrode, there is no line of electric force extending outwardly of the ground electrode and most of the resultant ions travel towards the ground electrode. In contrast thereto, however, in the present invention wherein the ground electrode 2 is of the generally U-shaped configuration having the split region 6 defined in a portion of the cylinder depicted by the ground electrode 2, some of the lines of electric force emanating from the needle electrode 1 extend outwardly of the ground electrode 2 through the split region 6 and the rest of the lines of electric force extend outwardly from the ion blowoff port 3 and, therefore, the ions can be blow off to the outside of the ion generator through the blowoff port 3 as best shown in FIG. 2A. It is, thus, readily be understood that the ions can emerge outwardly through the blowoff port 3.

On the other hand, where the plus ions are desired to be generated, the direct current voltage of +5 vK is applied from the high voltage generator 5 to the needle electrode 1 with the ground electrode 2 taken as a reference. Once this occurs, an electric field is developed and concentrates on the sharpened end of the needle electrode 1, resulting in a corona discharge occurring at the sharpened end of the needle electrode to thereby produce plus ions in a manner similar to that when the direct current voltage of −5 vK is applied. Since, however, the plus ions are charged to a plus charge, the plus ions travel towards along the lines of electric force and, therefore, most of the plus ions travel towards the ground electrode 2.

If the ground electrode of a ring shape such as the ground electrode 102 used in the conventional ion generator shown in FIGS. 12A to 12C is used so as to surround the imaginary extension M of the longitudinal axis of the needle electrode, there is no line of electric force extending outwardly of the ground electrode and most of the resultant ions travel towards the ground electrode. In contrast thereto, however, in the present invention wherein the ground electrode 2 is of the generally U-shaped configuration having the split region 6 defined in a portion of the cylinder depicted by the ground electrode 2, some of the lines of electric force emanating from the needle electrode 1 extend outwardly of the ground electrode 2 through the split region 6 and the rest of the lines of electric force extend outwardly from the ion blowoff port 3 and, therefore, the ions can be blow off to the outside of the ion generator through the blowoff port 3 as best shown in FIG. 2A.

In the embodiment shown in FIGS. 1A to 2B the ground electrode 2 is made of a generally rectangular metallic plate curled to represent a generally U-shaped configuration following the curvature of an inner peripheral wall surface of the casing 7 with the split region 6 defined on a portion of the shape of the cylinder occupied by the ground electrode 2, and is disposed within the casing 7 with the center of curvature thereof aligned with the longitudinal axis of the needle electrode 1.

Figure 3A:
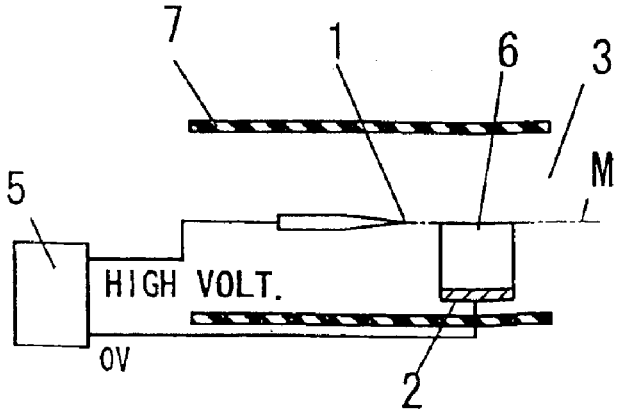
FIGS. 3A and 3B are views similar to FIGS. 1A and 1B, respectively, showing a second preferred embodiment of the present invention.
Figure 3B:
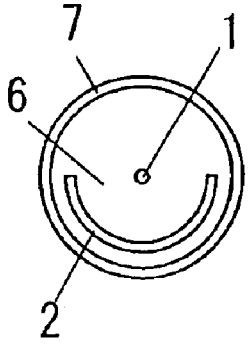

In a second preferred embodiment of the present invention shown in FIGS. 3A and 3B, the ground electrode 2 is made of a generally rectangular metallic plate curled to represent a substantially semispherical configuration following the curvature of the inner peripheral wall surface of the casing 7 with the split region 6 defined on one of halves of the shape of the cylinder occupied by the ground electrode 2. This semicircular sectioned ground electrode 2 is disposed within the casing 7 at a location forwardly of the needle electrode 1 with its center of curvature aligned with the longitudinal axis of the needle electrode 1.

Figure 4A:
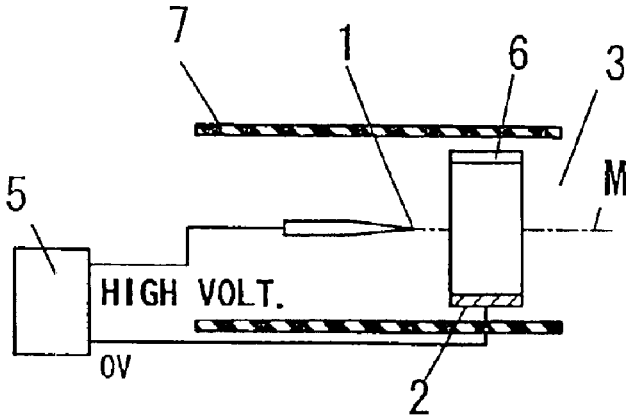
FIGS. 4A and 4B are views similar to FIGS. 1A and 1B, respectively, showing a third preferred embodiment of the present invention.
Figure 4B:
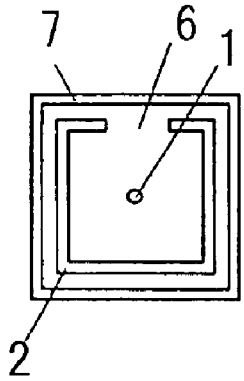
Figure 5A:
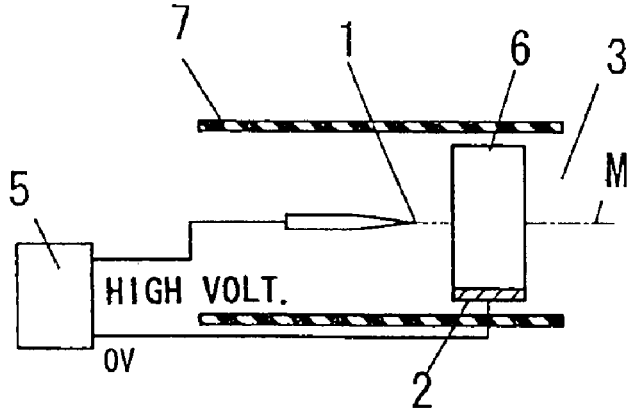
FIGS. 5A and 5B are views similar to FIGS. 1A and 1B, respectively, showing a fourth preferred embodiment of the present invention.
Figure 5B:
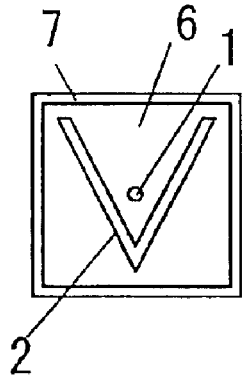

In third and fourth preferred embodiments of the present invention shown in FIGS. 4A and 4B and FIGS. 5A and 5B, respectively, the casing 7 has a polygonal, for example, square sectional shape. However, the third and fourth embodiments differ from each other in that the ground electrode 2 employed in the third embodiment has a generally square section having a portion of one of four side walls depleted to provide the split region 6 as best shown in FIG. 4B whereas the ground electrode 2 employed in the fourth embodiment has a substantially V-shaped section having the split region 6 delimited between free ends of respective side walls opposite to the joint therebetween as shown in FIG. 5B. In either embodiment, the square-sectioned or V-sectioned ground electrode 2 is made from an elongated, for example, rectangular metallic plate shaped to have a square sectional shape or a V-shaped section by the use of any known shaping technique, for example, a press work. As a matter of course, the square-sectioned or V-sectioned ground electrode 2 is positioned within the square-sectioned or V-sectioned casing 7 so as to surround the imaginary extension M of the needle electrode 1 with the side walls preferably spaced an equal distance therefrom.

It is eventually pointed out that the casing 7 may have any polygonal section, for example, a hexagonal, pentagonal or triangular section, other than the cylindrical configuration and, in correspondence therewith or independently thereof, the ground electrode 2 may have any other polygonal section with the split region 6 defined therein.

Figure 6A:
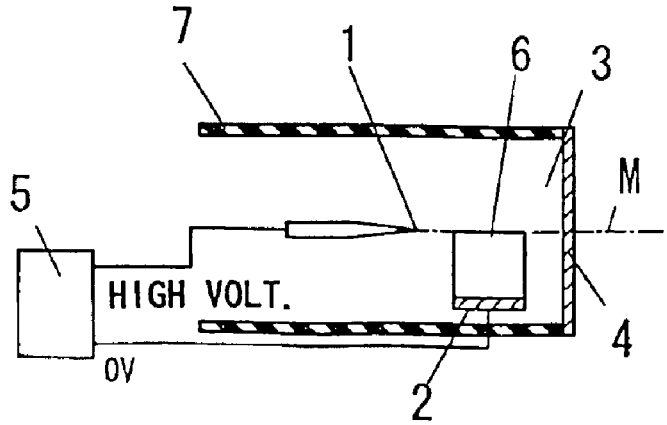
FIGS. 6A and 6B are views similar to FIGS. 1A and 1B, respectively, showing a fifth preferred embodiment of the present invention.
Figure 6B:
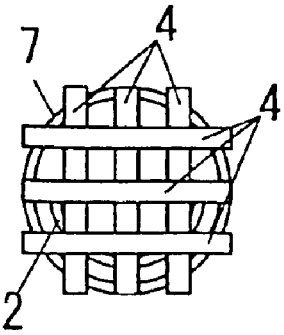

It is also to be noted that the ion blowoff port 3 may be covered by a generally apertured guard member 4 for preventing foreign matter from entering into the casing 7 through the ion blowoff port 3. In a fifth preferred embodiment of the present invention shown in FIGS. 6A and 6B, the generally apertured guard member 4 is in the form of a grille made up of a plurality of transverse and cross bars or wires. In a sixth preferred embodiment of the present invention shown in FIGS. 7A and 7B, the generally apertured guard member is in the form of a plurality of parallel bars or wires.

Referring now to FIGS. 8A and 8B showing a seventh preferred embodiment of the present invention, the guard member 4 is employed in the form of a single bar or wire and is positioned forwardly of the ground electrode 2 so as to cover the ion blowoff port 3 while traversing two sites on the sectional shape of the ground electrode 2. Specifically, in the embodiment shown in FIGS. 8A and 8B, the guard member extends in a direction perpendicular to, but slightly offset laterally from the imaginary extension M of the longitudinal axis of the needle electrode 1 while traversing the two sites on the sectional shape of the ground electrode 2 as best shown in FIG. 8B. In an eighth preferred embodiment of the present invention shown in FIGS. 9A and 9B, the guard member in the form of a similarly single bar or wire is so positioned frontwardly of the ground electrode 2 so as to extend across the imaginary extension M of the longitudinal axis of the needle electrode 1 while traversing the two sites on the sectional shape of the ground electrode 2 as best shown in FIG. 9B.

If the single bar guard member were to be so positioned frontwardly of the ground electrode so as to extend in a diametric direction of the ion blowoff port 3 while traversing only one site on the sectional shape of the ground electrode such as shown in FIGS. 9C and 9D, the area at which the lines of electric force emanating outwardly through the ion blowoff port 3 are barred by the guard member will increase and the amount of the ions blown off outwardly through the blowoff port 3 would be decreased in the presence of the guard member. In contrast thereto, the use of the guard member 4 in the manner shown in FIGS. 8A and 8B or FIGS. 9A and 9B is effective to minimize the area at which the lines of electric force emanating outwardly through the ion blowoff port 3 are barred by the guard member and, therefore, the ions can be effectively discharged outwardly through the ion blowoff port 3.

Figure 10A:
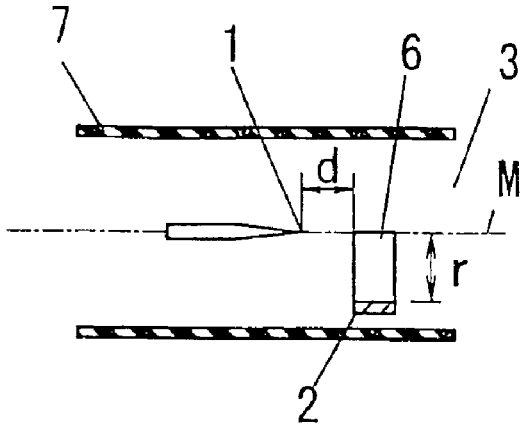
FIGS. 10A and 10B are views similar to FIGS. 1A and 1B, respectively, showing a ninth preferred embodiment of the present invention.
Figure 10B:
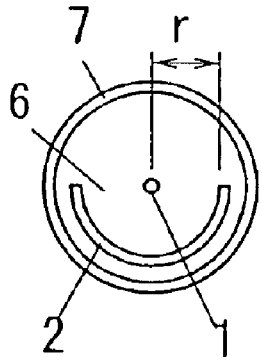

In a ninth preferred embodiment of the present invention shown in FIG. 10A and 10B, the concept of which is equally applicable not only to any one of the previously described various embodiments but also to subsequently described embodiments, the needle electrode 1 and the ground electrode 2, both within the casing 7, are so positioned relative to each other that the shortest possible distance d between the needle electrode 1 and the ground electrode 2, that is, the distance between the sharpened end of the needle electrode 1 and one of opposite side edges of the ground electrode 2 closest to the needle electrode 2 is equal to or substantially equal to the radius of curvature r of the ground electrode 2 or the distance between the imaginary extension M of the needle electrode 1 and the inner wall surface of the ground electrode 2.

The necessity of the shortest possible distance d between the needle electrode 1 and the ground electrode 2 to have a particular relation with the radius of curvature r as discussed above is based on the reason which will now be described with particular reference to FIGS. 11A and 11B.

Figure 11A:
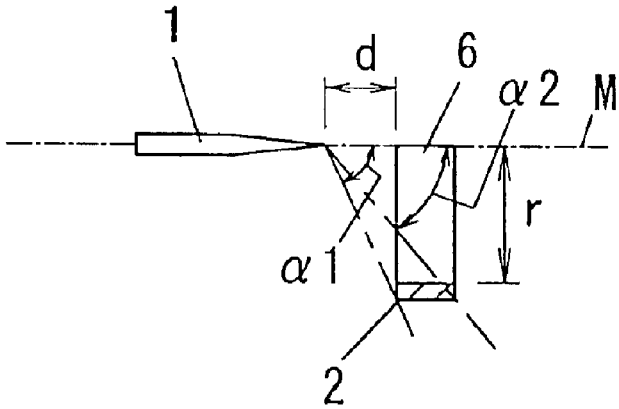
FIGS. 11A and 11B are schematic diagrams showing how the principle of operation of the ion generator shown in FIGS. 10A and 10B varies depending on the position of a ground electrode used therein, respectively.

Assuming that in the ion generator of the arrangement shown in FIGS. 3A and 3B in which the semicircular sectioned ground electrode 2 is employed, the shortest possible distance d is fixed and the radius of curvature r is greater than the shortest possible distance d as shown in FIG. 11A, the angles $\alpha 1$ and $\alpha 2$ between the direction of propagation of the lines of electric force extending from the needle electrode 1 toward the opposite side edges of the ground electrode 2, which are parallel to the imaginary extension M of the longitudinal axis of the ground electrode 2, and such imaginary extension M where the split region 6 exists, respectively, are so large that some of the lines of electric force propagating from the needle electrode 1 towards the ground electrode 2 will hardly emerge outwardly through the split region 6 with the amount of the electric force lines consequently reduced.

Figure 11B:
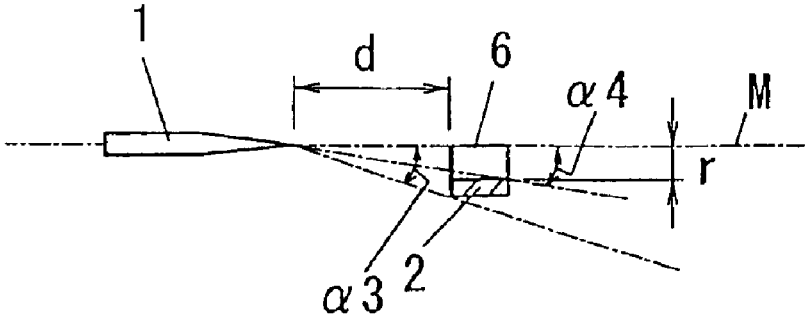

On the other hand, if the shortest possible distance d is fixed and the radius of curvature r is smaller than the shortest possible distance d as shown in FIG. 11B, the angles $\alpha 3$ and $\alpha 4$ between the direction of propagation of the lines of electric force extending from the needle electrode 1 toward the opposite side edge of the ground electrode 2, which are parallel to the imaginary extension M of the longitudinal axis of the ground electrode 2, and such imaginary extension M where the split region 6 exists, respectively, are small. In this condition, although the amount of the electric force lines which would emerge outwardly through the split region 8 appears to be large, the difference between the distance (i.e., the shortest possible distance) from the needle electrode 1 to one of the opposite side edges of the ground electrode 2 closest to the needle electrode 1 and the distance (i.e., the longest possible distance) from the needle electrode 1 to the other of the opposite side edge of the ground electrode 2 remote from the needle electrode 1 becomes so large that the electric force lines tend to concentrate on the side edge of the ground electrode 2 closest to the needle electrode 1 in a high density and, for this reason, the amount of the electric force line tending to emerge outwardly through the split region 6 is consequently reduced.

As discussed above, where r>d and r<d, the amount of ions emerging outwardly through the split region 6 is small either and, accordingly r=d or r≈ is desirable in order for the ions to be emitted through the split region 6 of the ground electrode 2 most efficiently.

Figure 14:
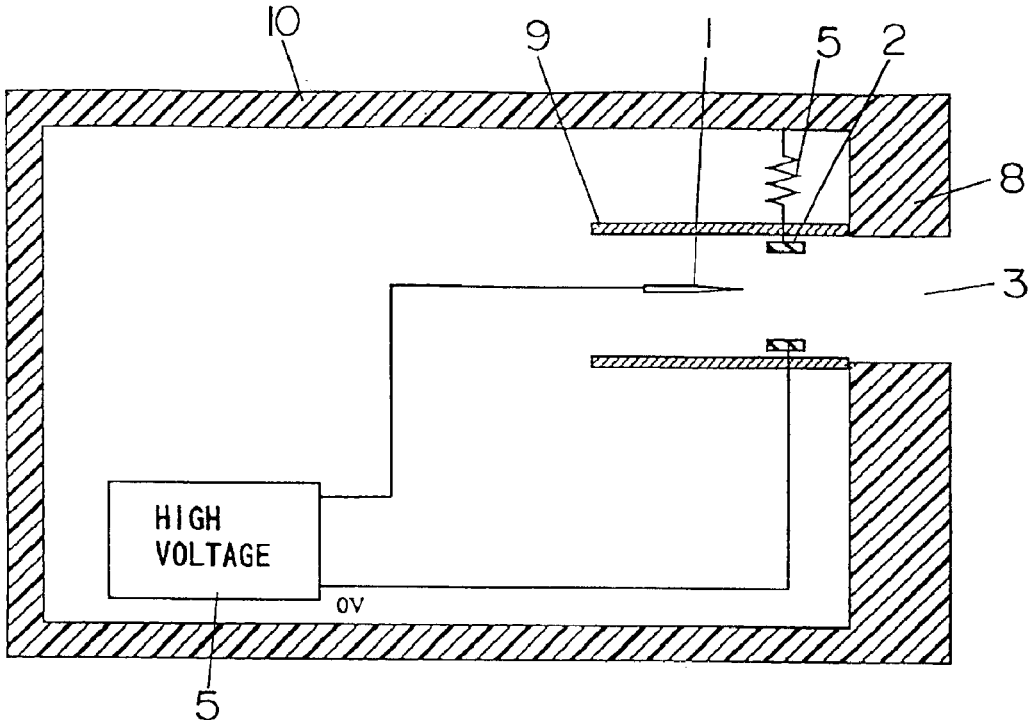
FIG. 14 is a schematic longitudinal sectional view of the ion generator according to a tenth preferred embodiment.
Figure 15:
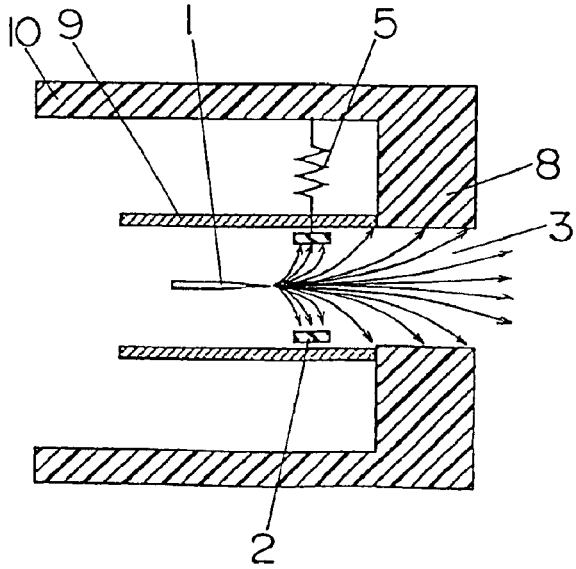
FIG. 15 is a fragmentary longitudinal sectional view of a portion of the ion generator shown in FIG. 14, showing the principle of operation thereof.

Referring now to FIGS. 14 and 15, there is shown the ion generator according to a tenth preferred embodiment of the present invention. The ion generator A shown therein includes a needle electrode 1, a ground electrode 2 and a high voltage generator 5. The needle electrode 1 and the ground electrode 2 are accommodated within a casing 9 made of an electrically insulating material, which casing 9 is in turn accommodated within a housing 10 together with the high voltage generator 5. The casing 9 has an ion blowoff port 3 defined at one end thereof and opens outwardly through an outer body 8 carried by the housing 10. The needle electrode 1 and the ground electrode 6 are disposed inside the casing 9 with the ground electrode 2 positioned forwardly of the needle electrode 1 and adjacent the ion blowoff port 3.

The needle electrode 1 is of a shape generally similar to a sewing needle, having one end thereof sharpened. The ground electrode 2 positioned forwardly of the needle electrode 1 is made of a metallic plate curled to represent a generally U-shaped configuration to follow the curvature of an inner peripheral wall of the casing 9.

The high voltage generator 5 is, where minus ions, for example, are desired to be generated, used to apply a direct current voltage of −5 kV to the needle electrode 1 relative to a reference potential assumed by the ground electrode 2. Conversely, the reverse is true where plus ions are desired to be generated, that is, the direct current voltage of +5 kV is applied to the ground electrode 2 relative to the reference potential assumed by the needle electrode 1.

The housing 10 is a molded article made of, for example, a plastic material and is electrically connected with the ground electrode 2 through a resistor 2 for avoiding electrification of the outer body 8 of the housing 10 that surrounds the ion blowoff port 3. It is eventually pointed out that the outer body 8 is also made of a plastic molding material and is integrally molded together with the housing 10 and, therefore, a portion of the housing 10 where the electrification appears to be most effectively avoided, that is, a portion of the outer body 8 around the ion blowoff port 4 is directly connected with the ground electrode 2 or a position adjacent the outer body 8 is connected with the ground electrode 2 through the resistor 5.

Assuming that the direct current voltage of −5 kV is applied from the high voltage generator 5 to the needle electrode 1 with the ground electrode 2 used as, a reference, an electric field is developed and concentrates on the sharpened end of the needle electrode 1, resulting in a corona discharge occurring at the sharpened end of the needle electrode 1 to thereby produce minus ions. Since the minus ions are charged to a minus charge, the minus ions travel along lines of electric force and, therefore, most of the minus ions travel towards the ground electrode 2.

Figure 30:
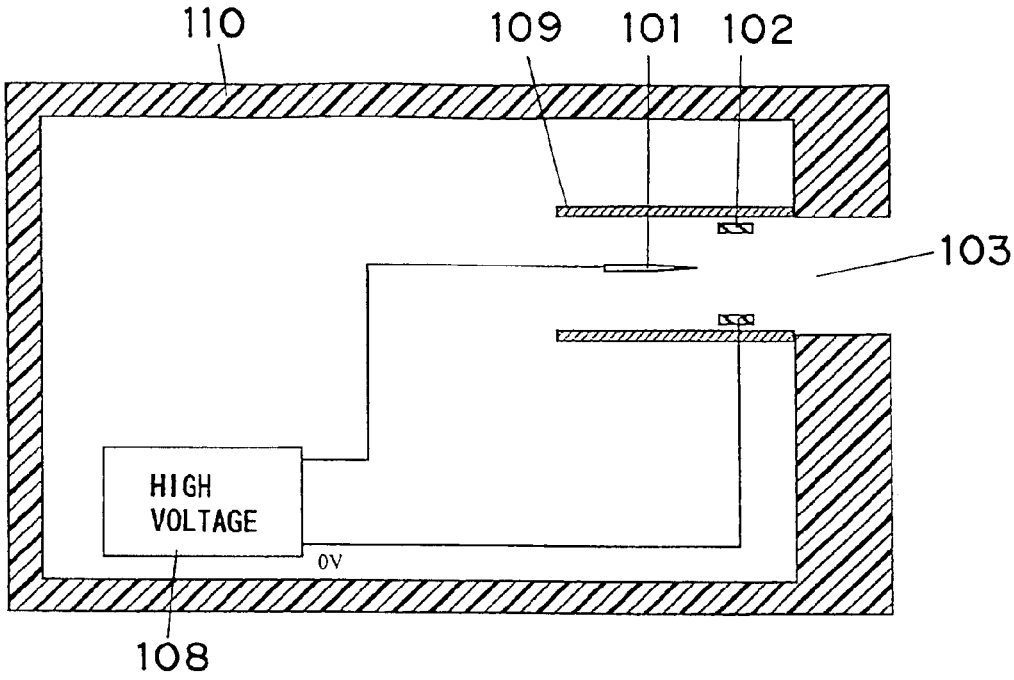
FIG. 30 is a schematic longitudinal sectional view of a further conventional ion generator.
Figure 31:
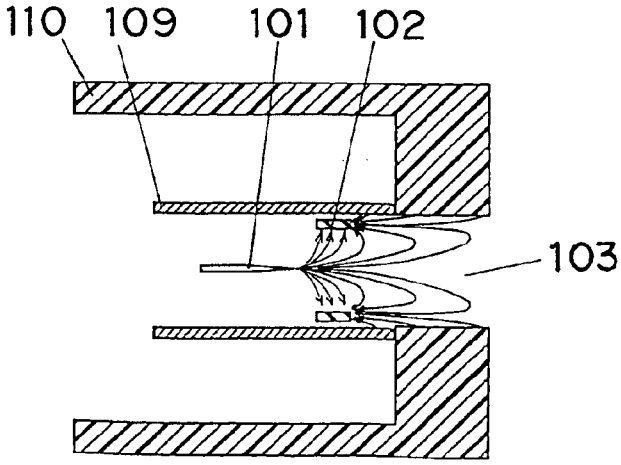
FIG. 31 is a fragmentary longitudinal sectional view of a portion of the conventional ion generator of FIG. 30, showing the principle of operation thereof.

In the conventional ion generator such as shown in FIG. 30, since the outer body 8 surrounding the ion blowoff port and exposed to the outside tends to be electrostatically charged to a negative potential, there is no line of electric force extending outwardly through the ion blowoff port 3 and, consequently, most of the resultant ions do not emerge outwardly from the ion blowoff port 3 as shown in FIG. 31.

In contrast thereto, in the illustrated embodiment of the present invention, since the ground electrode 2 is connected through the resistor 5 with the ion blowoff port 3 or the outer body 8 that is disposed in the vicinity of the ion blowoff port 3 so as to be exposed to the outside, electrification hardly occurs at that portion around the ion blowoff port 3, allowing lines of electric force to extend outwardly through the ion blowoff port 3 as shown in FIG. 15. Accordingly, most of the resultant ions can emerge outwardly through the ion blowoff port 3.

On the other hand, where the plus ions are desired to be generated, the direct current voltage of +5 vK is applied from the high voltage generator 5 to the needle electrode 1 with the ground electrode 2 taken as a reference. Once this occurs, an electric field is developed and concentrates on the sharpened end of the needle electrode 1, resulting in a corona discharge occurring at the sharpened end of the needle electrode 1 to thereby produce plus ions in a manner similar to that when the direct current voltage of −5 vK is applied. Since, however, the plus ions are charged to a plus charge, the plus ions travel towards along the lines of electric force and, therefore, most of the plus ions travel towards the ground electrode 2.

In the conventional ion generator such as shown in FIG. 30, since the outer body 8 surrounding the ion blowoff port and exposed to the outside tends to be electrostatically charged to a positive potential, there is no line of electric force extending outwardly through the ion blowoff port 3 and, consequently, most of the resultant ions do not emerge outwardly from the ion blowoff port 3 as shown in FIG. 31.

In contrast thereto, in the illustrated embodiment of the present invention, since the ground electrode 2 is connected through the resistor 5 with the ion blowoff port 3 or the outer body 8 that is disposed in the vicinity of the ion blowoff port 3 so as to be exposed to the outside, electrification hardly occurs at that portion around the ion blowoff port 3, allowing lines of electric force to extend outwardly through the ion blowoff port 3 as shown in FIG. 15. Accordingly, most of the resultant ions can emerge outwardly through the ion blowoff port 3.

Figure 16:
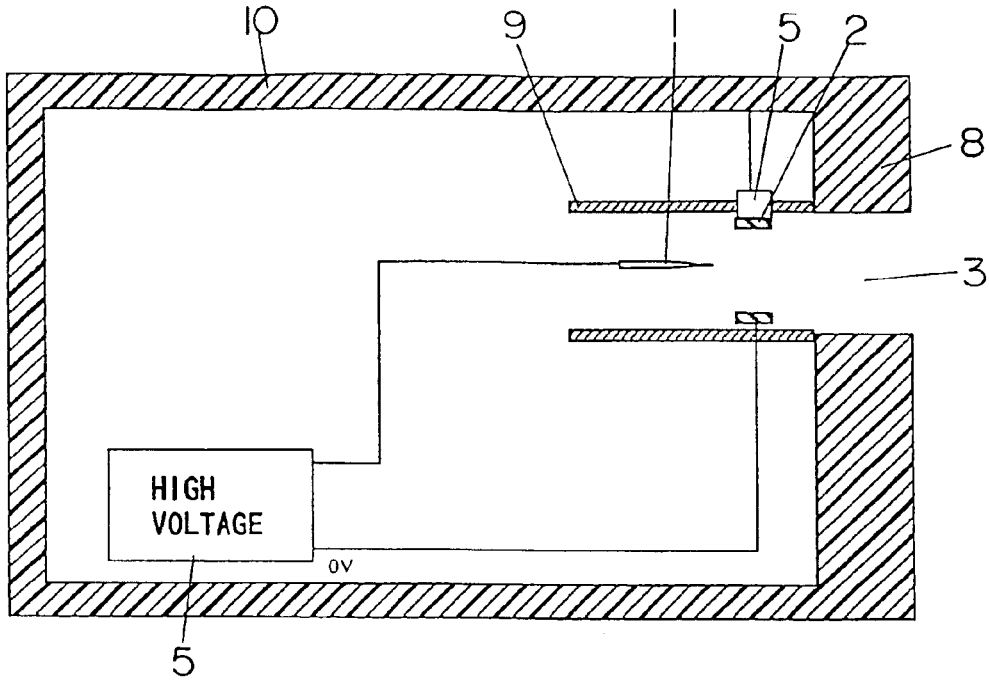
FIG. 16 is a view similar to FIG. 14, showing the ion generator according to an eleventh preferred embodiment of the present invention.

The resistor 5 used to connect the ground electrode 2 with the ion blowoff port 3 or the outer body 8 disposed in the vicinity of the ion blowoff port 3 may be a semiconductor or a high resistance element such as, for example, a tube having a high resistance. In an embodiment shown in FIG. 16, the resistor 5 in the form of a semiconductor or a high resistance element is connected with a portion of the ground electrode 2.

The outer body 8 disposed at or in the vicinity of the ion blowoff port 3 so as to be exposed to the outside may be defined by a portion of the housing 10 adjacent and around the ion blowoff port 3, or may be a member which is separate from the housing 10 and is therefore fitted to the housing 10 so as to occupy a position adjacent and around the ion blowoff port 3.

Figure 17:
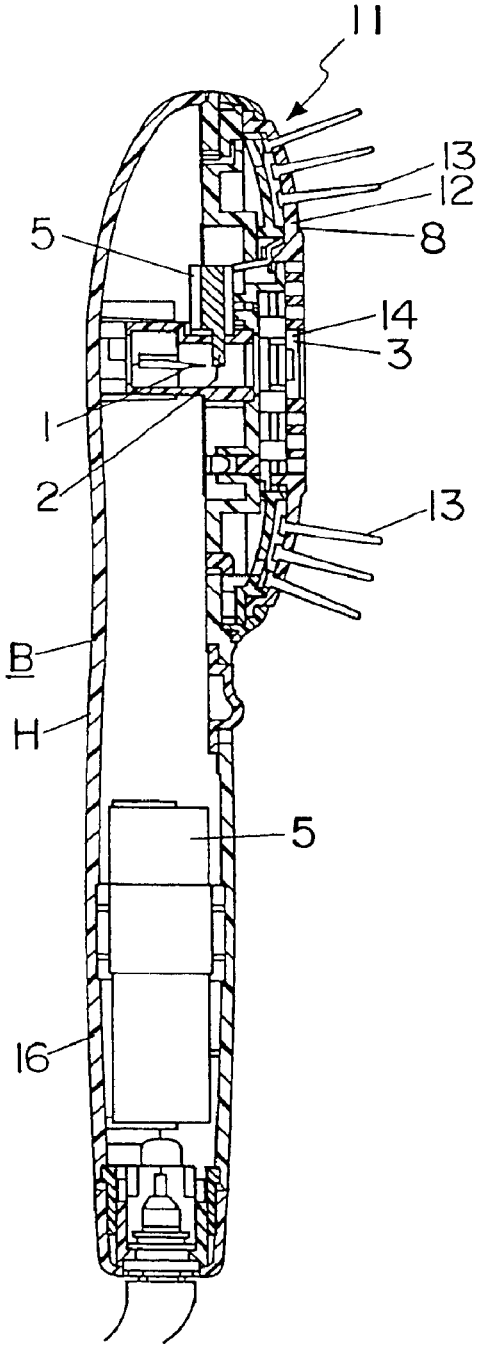
FIG. 17 is a longitudinal sectional view of a hairbrush incorporating the ion generator of the present invention according to a twelfth preferred embodiment of the present invention.
Figure 18:
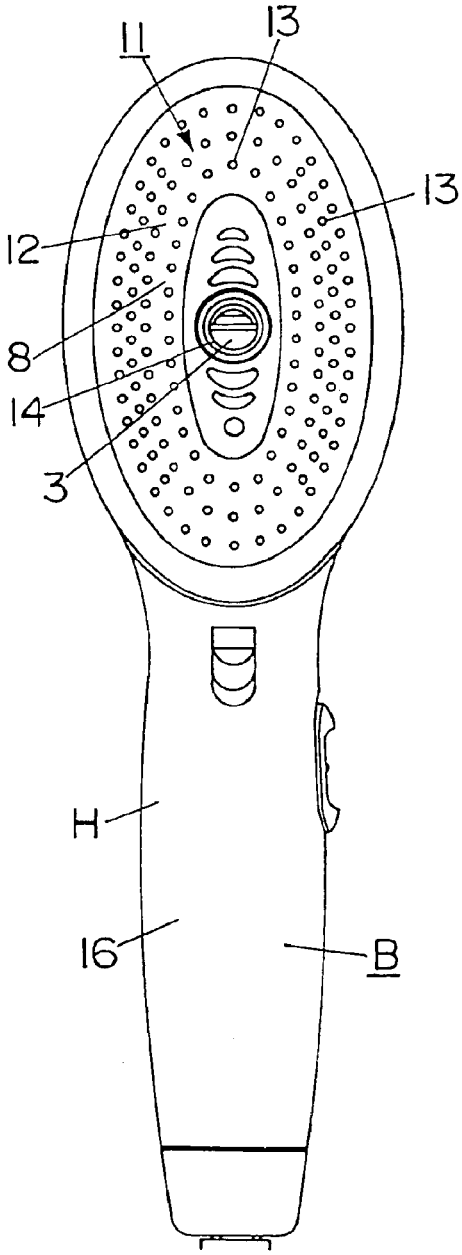
FIG. 18 is a front elevational view of the hairbrush shown in FIG. 17.

Referring now to FIGS. 17 and 18, there is shown a twelfth preferred embodiment of the present invention that is applied to a hairbrush. The hairbrush generally identified by B includes a generally elongated housing H. This housing H in turn includes a tubular handle 16 and a brush head 11 at one end of the handle 16 and facing in one direction laterally with respect to the longitudinal axis of the elongated housing H. The brush head 11 has a generally oval brush base 12 on which a multiplicity of bristles 13 are fixedly planted, or otherwise formed integrally therewith by means of an injection molding technique. The brush base 12 also has a center hole 14 aligned with the ion blowoff port 3 of the ion generator A, encased within the brush head 11 together with the casing 9, so that ions generated from the ion generator A can emerge outwardly of the brush head 11 through the center hole 14 by way of the ion blowoff port 3 to deposit on the user's hair during the hair brushing. As hereinbefore described, the casing 9 accommodates therein the needle electrode 1 and the ground electrode 2. The high voltage generator 5 is accommodated within the handle 16.

It is to be noted that the outer body 8 referred to hereinbefore is, in the embodiment shown in FIGS. 17 and 18, defined by the brush base 12 and the resistor 5 referred to hereinbefore is connected between the brush base 12 and the ground electrode 2 to avoid electrification of the brush base 12. The housing 10 referred to hereinbefore is, in the embodiment of FIGS. 17 and 18, defined by the hairbrush housing H.

It will readily be seen that the hairbrush B having a capability of emitting ions can be obtained by providing the center opening 14 in the brush base 12 in alignment with the ion blowoff port 3 and by connecting the brush head 11 with the ground electrode 2 through the resistor 5.

Although in the embodiment shown in FIGS. 17 and 18, the ion generator A is incorporated in the brush head 11 having the brush base 12 defining the outer body 8, the present invention may not be limited thereto and can be equally applied to an air cleaner or a hair drier. Where the ion generator A of the present invention is used in the air cleaner, a louver or grille of the air cleaner, positioned in alignment with the ion blowoff port 3, will define the outer body 8, and where it is applied to the hair drier, a blow nozzle, which defines the ion blowoff port 3 by itself, will define the outer body 8.

Figure 19:
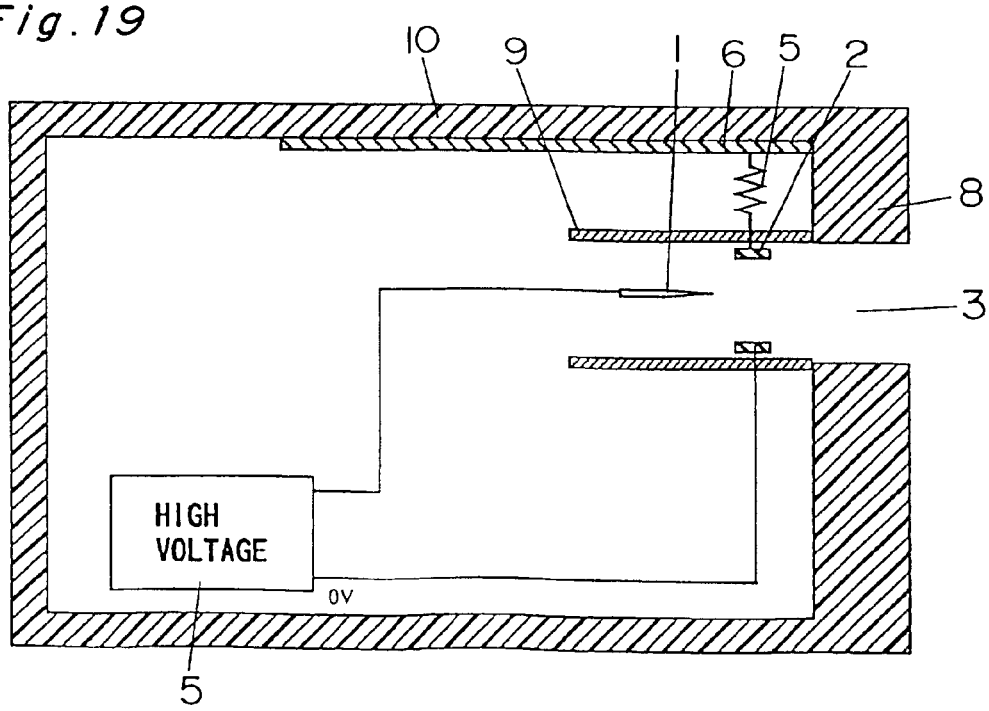
FIG. 19 is a schematic longitudinal sectional view of the ion generator according to a thirteenth preferred embodiment of the present invention.

Referring to FIG. 19 showing a thirteenth preferred embodiment of the present invention, an electroconductive plate 6 is fitted to an inner surface of the housing 10 and the outer body 8 forming a part of the housing 10 is connected with the electroconductive plate 6. The electroconductive plate 6 is in turn connected with the ground electrode 2 through the resistor 5. To connect the outer body 8 with the electroconductive plate 6 and then to connect the electroconductive plate 6 and the ground electrode 2 together through the resistor 5 is advantageous in that a distribution of electrification of the outer body 8 can be minimized to enable the resultant ions to be stably emitted outwardly through the ion blowoff port 3.

In an alternative embodiment though not shown, the outer body 8 disposed adjacent an ion blowoff port 3 and exposed to the outside may be made of an antistatic material such as, for example, an electroconductive synthetic resin (for example, an electroconductive ABS), and this outer body made of the antistatic material is then connected with the ground electrode 2. Where in this alternative embodiment the electroconductive ABS is used for the antistatic material, while ABS material generally has a volume resistivity not lower than $10^{10}$ Ωcm, the electroconductive ABS used as the antistatic material should have a volume resistivity of not higher than $10^{10}$ Ωcm.

Various preferred embodiments of the hairbrush B equipped with the ion generator of the present invention will now be described with reference to FIGS. 20 to 29.

Figure 20:
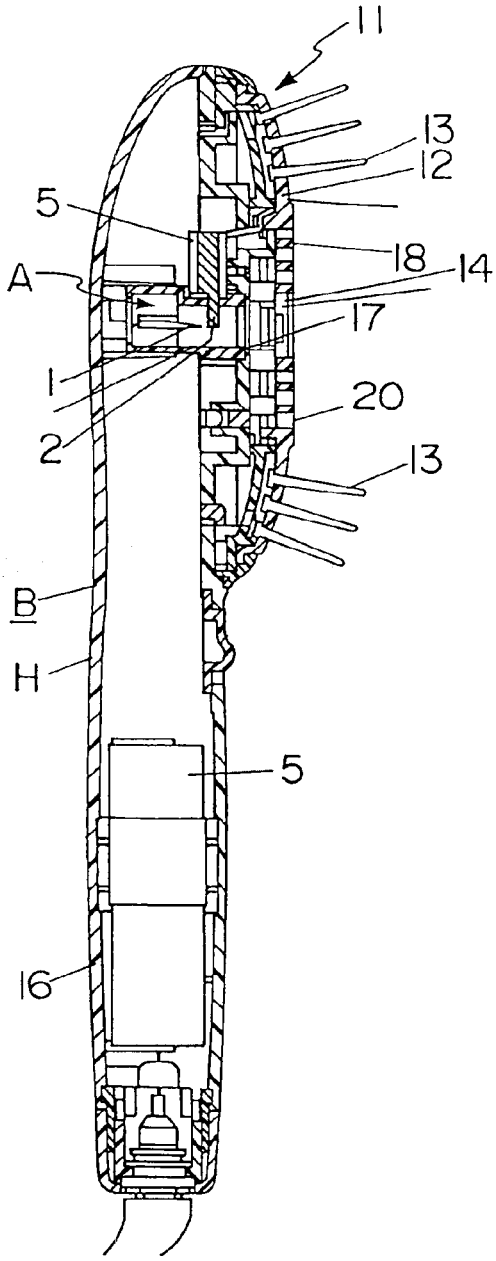
FIGS. 20 and 21 are views similar to FIGS. 17 and 18, respectively, showing the hairbrush according to a fourteenth preferred embodiment of the present invention.
Figure 21:
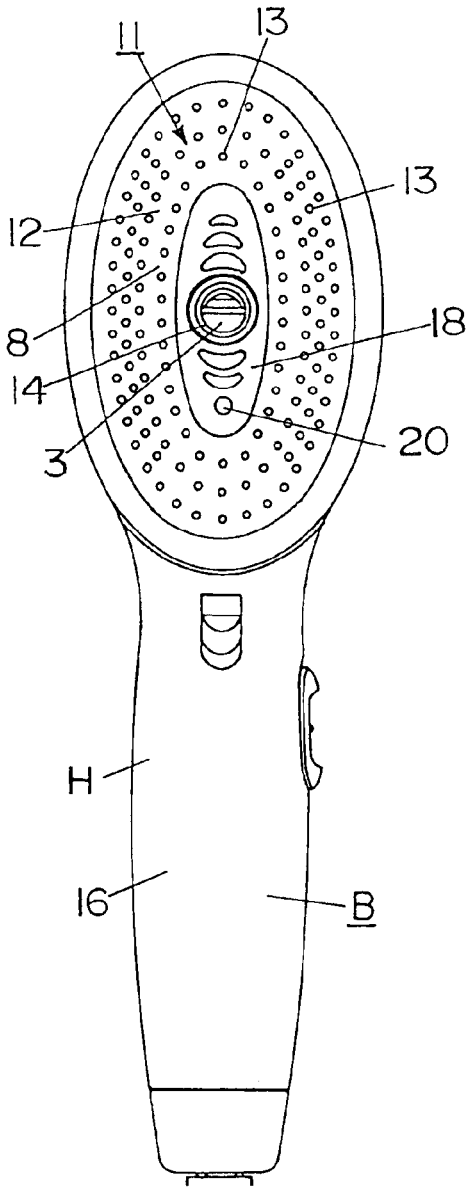

The hairbrush B shown in FIGS. 20 and 21 is substantially identical with that shown in FIGS. 17 and 18. As shown in FIGS. 20 and 21, the ion generator A is disposed within the brush head 11 forming a part of the hairbrush housing H. As is the case with the hairbrush B shown in FIGS. 17 and 18, the housing H includes, in addition to the brush head 11, a tubular handle 16. The brush head 11 has a generally oval brush base 12 on which a multiplicity of bristles 13 are fixedly planted, or otherwise formed integrally therewith by means of an injection molding technique. The brush base 12 also has a center hole 14 aligned with the ion blowoff port 3 of the ion generator A so that ions generated from the ion generator A can emerge outwardly of the brush head 11 through the center hole 14 by way of the ion blowoff port 3 to deposit on the user's hair during the hair brushing.

In defining the center opening 14 aligned with the ion blowoff port 3, two cases can be contemplated. Specifically, in one case, the center opening 14 is formed directly in the brush base 12 such as shown and, in the other case, the center opening 14 is defined in an opening defining member formed in a member defining the brush base 12 (that is, where the member defining the brush base 12 and the opening defining member are members separate from each other or are made of different materials, the center opening 14 is defined in the opening defining member). While the multiplicity of the bristles 13 are formed on the brush base 12 so as to protrude outwardly therefrom, some of the bristles around the center opening 14 are removed from the brush base 12 to define a plain surface area 18.

As hereinbefore discussed, the ion generator A includes the casing 9, encasing the needle electrode 1 and the ground electrode 2 therein, and the high voltage generator 5. The casing 9 is of a tubular or cylindrical configuration having a forward open end 17 defining the ion blowoff port 3 that is aligned with the center opening 14 defined in the brush base 12 and also with the longitudinal axis of the needle electrode 1. The needle electrode 1 may be in the form of, for example, a slender metallic rod having one end sharpened and, on the other hand, the ground electrode 2 is in the form of, for example, a metallic plate and positioned diagonally forwardly of the needle electrode 1. The high voltage generator 5 is, where minus ions, for example, are desired to be generated, used to generate a direct current voltage of −5 kV and the ground electrode 2 and the needle electrode 1 are connected to a reference potential terminal and a high voltage terminal of the high voltage generator 5, respectively. Conversely, where plus ions are desired to be generated, the high voltage generator 5 is used to generate a direct current voltage of +5 kV with the reference potential terminal and the high voltage terminal connected respectively with the ground electrode 2 and the needle electrode 1, respectively.

Where the minus ions are desired to be generated, the direct current voltage of −5 kV is applied from the high voltage generator 5 to the needle electrode 1 with the ground electrode 2 used as a reference, so that an electric field is developed and concentrates on the sharpened end of the needle electrode 1, resulting in a corona discharge occurring at the sharpened end of the needle electrode 1 to thereby produce minus ions.

Figure 22:
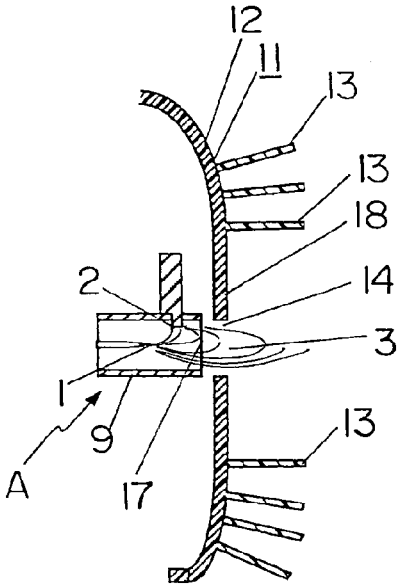
FIG. 22 is a fragmentary longitudinal sectional view of a brush head of the hairbrush shown in FIGS. 20 and 21, showing the principle of operation of the ion generator used in that hairbrush of FIGS. 20 and 21.
Figure 34:
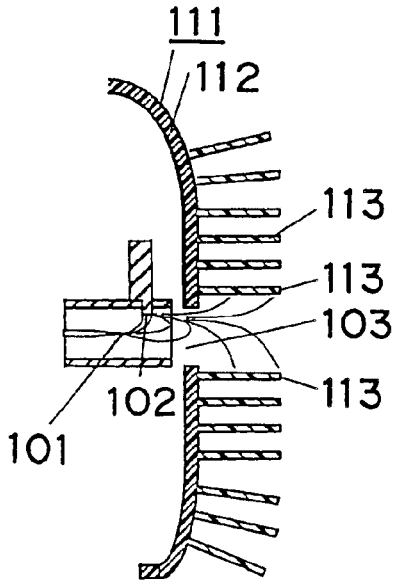
FIG. 34 is a fragmentary longitudinal sectional view of the brush head of the hairbrush shown in FIGS. 32 and 31, showing the principle of operation of the ion generator used in that hairbrush.
Figure 32:
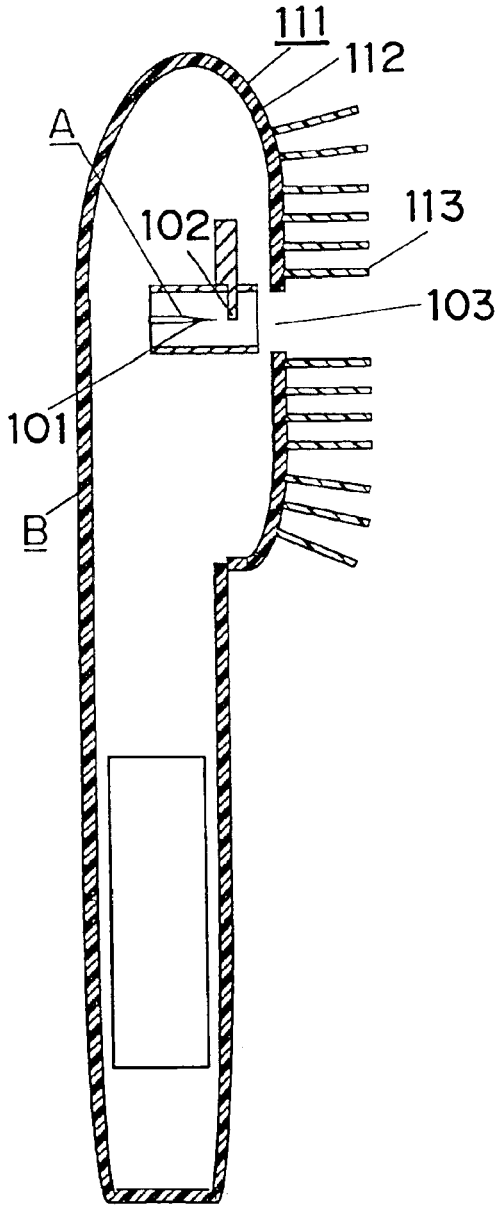
FIGS. 32 and 33 are views similar to FIGS. 17 and 18, showing the hairbrush contemplated by the inventors of the present invention, respectively.
Figure 33:
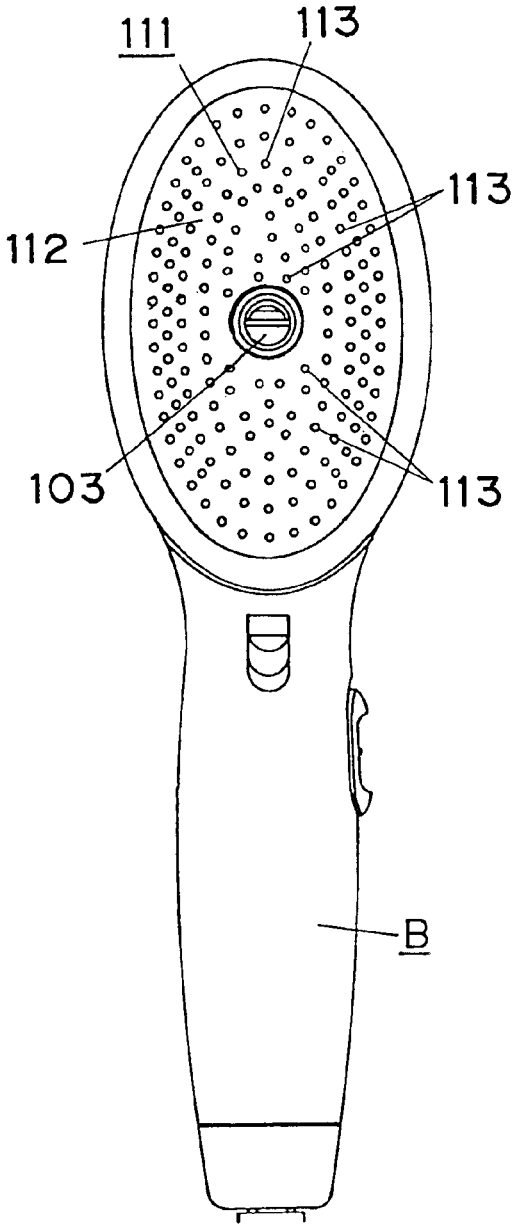

In the conventional hairbrush shown in FIGS. 32 and 33, the bristles 13 tend to be charged to a negative potential and, therefore, a problem has been found in that the lines of electric force do not emerge outwardly from the brush head 11 as shown in FIG. 34. However, in the present invention, since the plain surface area 18 where no bristle is formed is defined around the center opening 14 aligned with the ion blowoff port 3, the minus ions would hardly deposit on the bristles 13 and the bristles 13 would therefore hardly be charged to a negative potential. Also, the presence of the plain surface area 18 in the brush base 12 separates the bristles 13 a substantial distance away from the center opening 14 aligned with the ion blowoff port 3. Accordingly, in the present invention, as shown in FIG. 22, the lines of electric force extend outwardly of the brush head 11 through the ion blowoff port 3 and then through the center opening 14, resulting the ions to be emitted outside the brush head 11.

Hair brushing with the use of the hairbrush B provided with the ion generator A allows the minus ions to impinge upon hairs so that the hairs can be rendered dampish and rustling. Also, impingement of the minus ions upon the scalp brings about an effect of promoting hair restoration.

Where the plus ions are desired to be generated, the direct current voltage of +5 kV is applied from the high voltage generator 5 to the needle electrode 1 with the ground electrode 2 used as a reference, so that an electric field is developed and concentrates on the sharpened end of the needle electrode 1, resulting in a corona discharge occurring at the sharpened end of the needle electrode 1 to thereby produce plus ions. Since the plus ions are charged to a plus charge, the plus ions travel towards along the lines of electric force.

In the conventional hairbrush, the bristles 13 tend to be charged to a positive potential and, therefore, a problem has been found in that the lines of electric force do not emerge outwardly from the brush head 11. However, in the present invention, since the plain surface area 18 where no bristle is formed is defined around the center opening 14 aligned with the ion blowoff port 3 as shown in FIGS. 20 and 21, the plus ions would hardly deposit on the bristles 13 and the bristles 13 would therefore hardly be charged to a positive potential. Also, the presence of the plain surface area 18 in the brush base 12 separates the bristles 13 a substantial distance away from the center opening 14 aligned with the ion blowoff port 3. Accordingly, in the present invention, as shown in FIG. 22, the lines of electric force extend outwardly of the brush head 11 through the ion blowoff port 3 and then through the center opening 14, resulting the ions to be emitted outside the brush head 11.

When the plain surface area 18 is to be defined in the brush base 12 at a location around the center opening 14, it is preferred, in accordance with a fifteenth preferred embodiment of the present invention, that no bristle 13 is disposed within a cone N having its apex occupied by the sharpened end of the needle electrode 1 and flaring outwardly from the sharpened end of the needle electrode 1 to the outside of the brush head 11 through the center opening 14 in touch with a peripheral lip region defining the ion blowoff port 3 and/or the center opening 14. In other words, so that no bristle 13 exist within the cross-hatched conical area N, some of the bristles 13 on the brush base 12 around the center opening 14 are depleted to provide the plain surface area 18, while the side of the cone N with its apex occupied by the sharpened end of the needle electrode 1 lies in touch with the peripheral lip region of the ion blowoff port 3 and/or the center opening 14. The absence of the bristles within the area, i.e., the plain surface area 18 encompassed by this cone N ensures that no ions will deposit on the bristles, making it difficult for the bristles 13 to be electrostatically charged. Also, since the bristles 13 are separated a substantial distance away from the center opening 14, the lines of electric force can extend outwardly through the ion blowoff port 3 and then through the center opening 14 and, therefore, the ions can emerge outwardly from the brush head 11 through the center opening 14.

Hair brushing with the use of the hairbrush B provided with the ion generator A allows the minus ions to impinge upon hairs so that the hairs can be rendered dampish and rustling. Also, impingement of the minus ions upon the scalp brings about an effect of promoting hair restoration.

The hairbrush B according to a sixteenth preferred embodiment of the present invention will now be described with reference to FIG. 24. The hairbrush B equipped with the ion generator A shown in FIG. 24 is similar in structure to that shown in FIGS. 20 to 22 or FIG. 13 and, accordingly, only the difference between it and the other embodiment shown in FIGS. 20 to 22 or FIG. 23 will be described.

Figure 24:
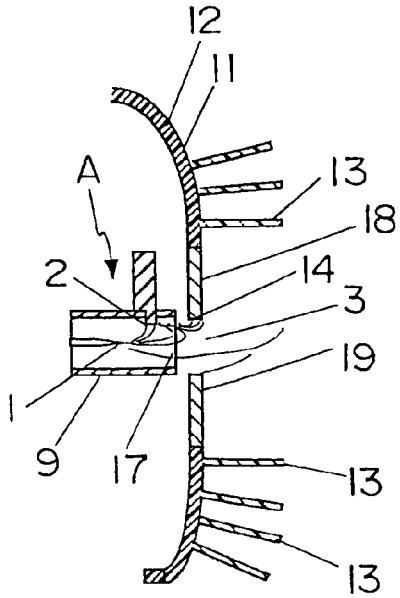

In the embodiment shown in FIG. 24, a portion of the brush base 12 around the center opening 14 and encompassed by the plain surface area 18 is made of a material having a low electroconductivity, which is different from the material used to form the remainder of the brush base 12. In other words, in this embodiment, the opening defining member, identified by 19, having a center opening 14 defined therein and made of the low electroconductivity material is employed and fitted in the brush base 12 to define the plain surface area 18. According to this embodiment, the use of the opening defining member 19 having a low electroconductivity is effective in that no electrostatic charge built on the brush base 12 would propagate towards the center opening 13 aligned with the ion blowoff port 3, allowing the lines of electric force to extend outwardly of the brush head 11 to thereby ensure a sure emission of the ions to the outside of the brush head 11.

While as hereinabove described that portion of the brush base 12 around the center opening 14 and encompassed by the plain surface area 18 is made of the material having a low electroconductivity, that is, the opening defining member 19 separate from the brush base 12 is employed, the material for the opening defining member 19 is preferably so soft and so flexible as to provide the user with a sensation to a pleasant feel during brushing.

Figure 25:
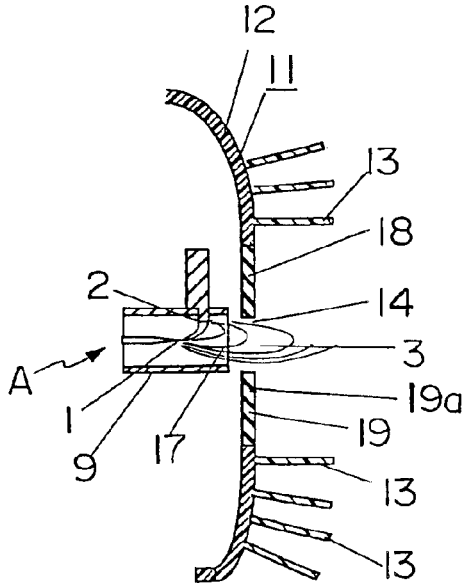

In a seventeenth preferred embodiment shown in FIG. 25, the opening defining member 19 is made of an electrically insulating material as shown by 19*a*. The use of the electrically insulating material for the opening defining member 19 is effective in that no electrostatic charge built on the brush base 12 would propagate towards the center opening 13 aligned with the ion blowoff port 3, allowing the lines of electric force to positively extend outwardly of the brush head 11 to thereby ensure a sure emission of the ions to the outside of the brush head 11.

Figure 26:
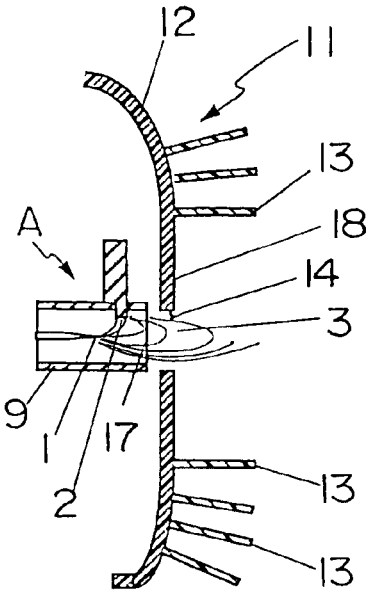

In an eighteenth preferred embodiment shown in FIG. 26, the brush base 12 and the bristles 13 are made of an antistatic material. In this embodiment, the center opening 14 aligned with the ion blowoff port 3 may be formed directly in the brush base 12 made of the antistatic material. Alternatively, even in the case with the embodiments shown in FIGS. 24 and 25, respectively, where the separate opening defining member 19 is employed, the brush base 12 and the bristles 13 may be made of the antistatic material. In any event, the use of the antistatic material for the brush base 12 and the bristles 13 makes it difficult for an electrostatic charge to be built up on the brush head 11, allowing the lines of electric force to positively extend outwardly of the brush head 11 to thereby ensure a sure emission of the ions to the outside of the brush head 11.

Figure 27:
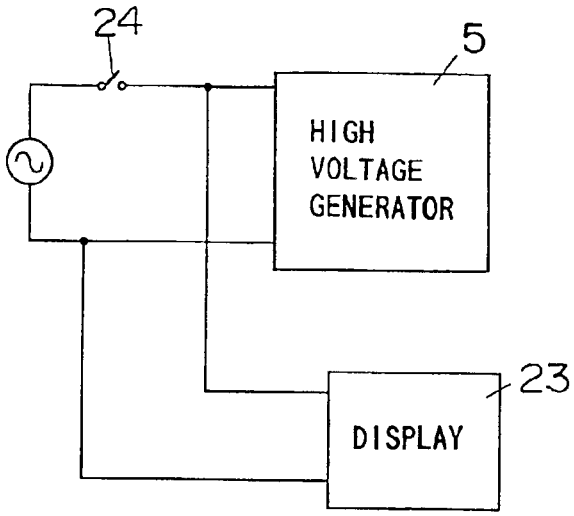
FIG. 27 is an electric circuit block diagram used in the ion generator of the present invention.
Figure 28:
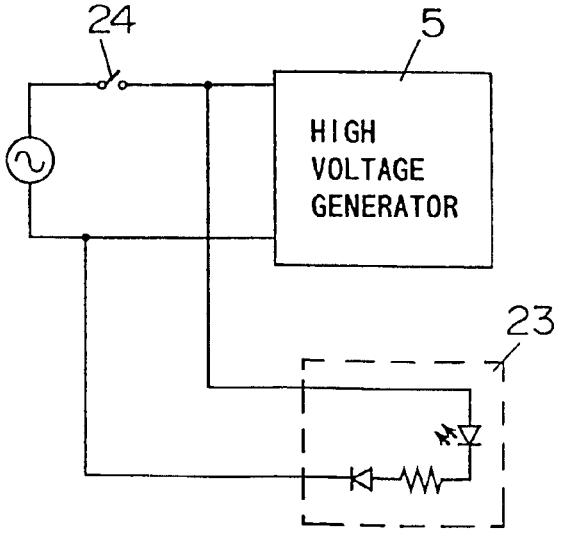
FIG. 28 is an electric circuit block diagram showing the details of the circuit shown in FIG. 27.

Referring back to FIGS. 20 and 21, the hairbrush B equipped with the ion generator in accordance with the present invention is provided with a display element 20 which is in the illustrated embodiment disposed in the plain surface area 18 at a location away from the center opening 14. This display element 20 is used to provide an indication of the ions being emitted when the ions are so generated. Accordingly, when the user of the hairbrush B looks at the display element 20, he or she can recognize the emission of the ions that are invisible to the naked eyes. In FIG. 27, a display circuit for activating the display element 20 referred to above when the ions are generated by the ion generator is shown. As shown therein, when the high voltage generator 5 is electrically powered on with a switch 24 turned on to thereby cause the ion generator A to generate the ions, the display circuit 23 is also powered on to drive the display element 20. The details of this display circuit 23 is shown in FIG. 28.

In the various embodiments shown respectively in FIGS. 20 to 22, FIG. 23, FIG. 24, FIG. 25 and FIG. 26, the ion blowoff port 3 defined in the casing 9 and the center opening 14 defined in the brush head 11 are shown as spaced a slight distance from each other. However, in a ninth preferred embodiment of the present invention shown in FIG. 29, an ion guide tube 21 made of an electrically insulating material is employed, having a rear end coupled with the forward end of the casing 9 and the other front end protruding outwardly through the center opening 14.

Figure 29:
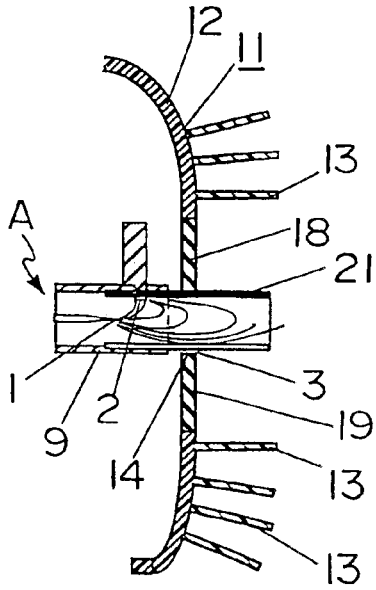
FIG. 29 is a view similar to FIG. 22, showing the ion generator according to an nineteenth preferred embodiment of the present invention.

Referring to FIG. 29, the ion guide tube 21 has its rear end inserted into the casing 9 and its front end extending through the center opening 14 so as to protrude outwardly of the plain surface area 18. The use of the ion guide tube 21 made of the electrically insulating material makes it difficult for the ions to deposit on an inner peripheral surface of the ion guide tube 21 and ensures that the ions generated by the ion generator A can be emitted outwardly of the brush head 11.

Considering that the front end of the ion guide tube 21 protrudes a distance outwardly from the plain surface area 18 in the brush head 11 as shown in FIG. 29, the bristles 13 will not be electrified and the ions generated can be blown off to the outside of the brush head 11 without being interfered with the bristles 13.

Figure 23:
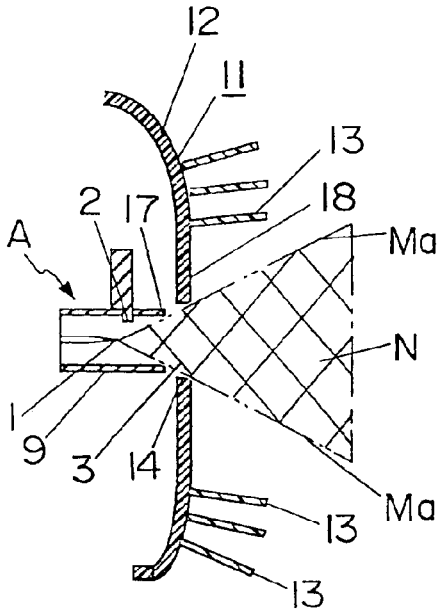
FIGS. 23 to 26 are views similar to FIG. 22, showing the ion generator according to fifteenth to eighteenth preferred embodiment of the present invention, respectively.

Although in the embodiment shown in FIG. 29, the brush head 11 is shown as utilizing the opening defining member 19 made of a low electroconductivity material or an electrically insulating material, the ion guide tube 21 can be equally employed in any one of the embodiments shown respectively in FIGS. 22 and 23.

It is to be noted that in any one of the foregoing embodiments shown respectively in FIGS. 20 to 22, FIG. 23, FIG. 24, FIG. 25, FIG. 26 and FIG. 29, the brush base 12 of the brush head 11 constitutes the outer body 8 discussed with reference to FIGS. 14 to 19, and the brush base 12 forming a part of the outer body 8 is electrically connected with the ground electrode 2 through the resistor 5 to avoid electrification of the brush base 12 formed with the bristles 13. Connection of the brush base 12, formed with the bristles 13, with the ground electrode 2 through the resistor 5 is effective to avoid electrification of the brush base 12 and the bristles 13 to thereby facilitate the lines of electric force to emerge outwardly through the ion blowoff port 3 and then through the center opening 14, resulting in a sure emergence of the ions outwardly of the brush head 11.

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

The present disclosure relates to subject matter contained in priority Japanese Patent Application Nos. 2000-358631, filed on Nov. 27, 2000, 2000-358632, filed on Nov. 27, 2000, and 2001-264786, filed on Aug. 31, 2001, the contents of all of which are herein expressly incorporated by reference in their entireties.

What is claimed is:

1. A hairbrush which comprises;

an ion generator for emitting ions; and a brush head having a brush base formed with a multiplicity of bristles, said brush base having an opening defined therein for passage of the ions from the ion generator to an outside of the hairbrush;

wherein some of the bristles around the opening in the brush base are removed to provide a plain surface area where no bristle exist, wherein the ion generator includes a discharge electrode and wherein a surface area encompassed by a cone having its apex occupied by the discharge electrode and flaring outwardly away from the discharge electrode and passing in touch with a peripheral lip region defining the opening in the brush base has no bristle.

2. The hairbrush as claimed in claim 1, wherein a portion of the brush base around the opening is made of a material having a low electroconductivity.

3. The hairbrush as claimed in claim 2, wherein a portion of the brush base around the opening is made of an electrically insulating material.

4. A hairbrush which comprises;

an ion generator for emitting ions; and a brush head having a brush base formed with a multiplicity of bristles, said brush base having an opening defined therein for passage of the ions from the ion generator to an outside of the hairbrush;

wherein some of the bristles around the opening in the brush base are removed to provide a plain surface area where no bristle exist, further comprising an ion guide tube made of an electrically insulating material intervening between the ion generator and the brush base for guiding the ions towards an outside of the hairbrush.

5. An ion generator which comprises a needle electrode, a ground electrode cooperable with the needle electrode to generate a corona discharge in the air to produce ions, an outer body disposed at or in a vicinity of an ion blowoff port, and a resistance element through which the ground electrode is connected with the outer body.

6. The ion generator as claimed in claim 5, wherein the resistance element is made of a material having a high resistance or a semiconductor.

7. The ion generator as claimed in claim 5, wherein the outer body is a brush head of a hairbrush.

8. The ion generator as claimed in claim 5, further comprising an electroconductive plate connected with the outer body, said electroconductive plate and said ground electrode being electrically connected together through the resistance element.

9. An ion generator which comprises a needle electrode, a ground electrode cooperable with the needle electrode to generate a corona discharge in the air to produce ions, an outer body disposed on an ion emission side and exposed to an outside, said outer body being made of an antistatic material and connected with the ground electrode.

* * * * *